US005145017A

United States Patent [19]

Holster et al.

[11] Patent Number: 5,145,017

[45] Date of Patent: Sep. 8, 1992

[54] KERF-CUTTING APPARATUS FOR INCREASED DRILLING RATES

[75] Inventors: Jesse L. Holster, Spring; Roy D. Estes, Weatherford; Jack Castle, Crowley; Paul G. Parys, Ft. Worth, all of Tex.

[73] Assignee: Exxon Production Research Company, Houston, Tex.

[21] Appl. No.: 638,234

[22] Filed: Jan. 7, 1991

[51] Int. Cl.[5] ..... E21B 10/04; E21B 10/06; E21B 10/14

[52] U.S. Cl. ..... 175/333; 175/336; 175/393; 175/404

[58] Field of Search ..... 175/333, 336, 339, 332, 175/404, 403, 393, 330

[56] References Cited

U.S. PATENT DOCUMENTS

| | | | |
|---|---|---|---|
| 2,667,334 | 1/1954 | Ortloff | 175/333 X |
| 2,807,443 | 9/1957 | Wyman | 175/404 |
| 2,872,169 | 2/1959 | Robbins et al. | 175/333 X |
| 3,055,443 | 9/1962 | Edwards | 175/330 |
| 3,095,053 | 6/1963 | Pistole et al. | 175/404 X |
| 3,100,544 | 8/1963 | Overly et al. | 175/404 X |
| 3,112,800 | 12/1963 | Bobo | 175/403 X |
| 3,215,215 | 11/1965 | Kellner | 175/330 |
| 3,385,385 | 5/1968 | Kucera et al. | 175/374 |
| 3,424,255 | 1/1969 | Mori et al. | 175/60 |
| 3;424,258 | 1/1969 | Nakayama | 175/333 |
| 3,433,331 | 3/1969 | Heyberger et al. | 175/330 |
| 3,542,142 | 11/1970 | Hasiba et al. | 175/67 |
| 3,756,332 | 9/1973 | Crane | 175/364 |
| 3,838,742 | 10/1974 | Juvkam-Wold | 175/380 |
| 3,845,830 | 11/1974 | Fowler et al. | 175/404 |
| 3,924,698 | 12/1975 | Juvkam-Wold | 175/393 |
| 4,006,788 | 2/1977 | Garner | 175/330 |
| 4,174,759 | 11/1979 | Arbuckle | 175/67 |
| 4,207,954 | 6/1980 | Jerome | 175/330 |
| 4,230,194 | 10/1980 | Logan, Jr. | 175/379 |
| 4,343,371 | 8/1982 | Baker, III et al. | 175/329 |
| 4,534,427 | 8/1985 | Wang et al. | 175/67 |
| 4,760,888 | 8/1988 | Saito | 175/259 |
| 4,892,159 | 1/1990 | Holster | 175/336 |
| 5,016,718 | 5/1991 | Tandberg | 175/404 X |

FOREIGN PATENT DOCUMENTS

| | | | |
|---|---|---|---|
| 841892 | 2/1952 | Fed. Rep. of Germany | 175/404 |
| 851333 | 10/1952 | Fed. Rep. of Germany | 175/332 |
| 197806 | 9/1978 | Fed. Rep. of Germany | 175/336 |
| 73/2541 | 5/1972 | South Africa . | |
| 77/6218 | 10/1977 | South Africa . | |
| 976007 | 11/1982 | U.S.S.R. | 175/333 |
| 1513118 | 10/1989 | U.S.S.R. | 175/336 |

*Primary Examiner*—Hoang C. Dang
*Attorney, Agent, or Firm*—Pamela L. Wilson

[57] ABSTRACT

An improved earth drilling bit and method that cuts at least one annular kerf ahead of at least one rolling cutter and provides for rock chip removal and bit cooling thereby increasing drilling rate and bit performance. One embodiment of the invention includes a bit body having a lower end forming an annular kerf cutter for cutting an outer annular kerf, an inner drill member positioned concentrically within the bit body having a lower end forming an annular kerf cutter for cutting an inner annular kerf, and at least one rolling cutter mounted to the bit body and extending from the interior of the outer kerf cutter to the longitudinal axis of the drill bit. Other embodiments include a chipway port defined by the drill bit for channeling rock chips away from beneath the bit; baffles for directing and accelerating drilling fluid flow; cutting edges having connecting webbs providing egress for rock chip and drilling fluid; and slots extending along the bit body for reducing surge and swab pressure.

14 Claims, 16 Drawing Sheets

KERF-CUTTING APPARATUS FOR INCREASED DRILLING RATES

FIELD OF THE INVENTION

The present invention relates generally to bits used in drilling earth formations. More specifically, the present invention concerns an improved apparatus and method for increased drilling rates by cutting concentric annular kerfs ahead of primary drilling means.

BACKGROUND OF THE INVENTION

Modern drilling operations used to create boreholes in the earth for the production of oil, gas and geothermal energy typically employ rotary drilling techniques. In rotary drilling, a borehole is created by rotating a tubular drill string having a drill bit secured to its lower end. As drilling proceeds, additional tubular segments are added to the drill string to deepen the hole. While drilling, a pressurized fluid is continually injected into the drilling string. This fluid passes into the borehole through one or more nozzles in the drill bit and returns to the surface through the annular channel between the drill string and the walls of the borehole. The drilling fluid carries the rock cuttings out of the borehole and also serves to cool and lubricate the drill bit.

One basic type of rotary rock drill is a drag bit. Some drag bits have steel or hard faced edges, but primarily they have a main body into the outer surface of which are embedded extremely hard cutting elements. These cutting elements are typically made of natural or synthetic diamonds. As the drag bit is rotated, the cutting elements scrape against the bottom and sides of the borehole to cut away rock.

Another basic type of rotary rock drill uses roller cone cutters mounted on the body of the drill bit so as to rotate as the drill bit is rotated. The angles of the cones and bearing pins on which they are mounted are aligned so that the cones essentially roll on the bottom of the hole with controlled slippage. One type of roller cone cutter is an integral body of hardened steel with teeth formed on its periphery. Another type has a steel body with a plurality of tungsten carbide or similar inserts of high hardness that protrude from the surface of the body somewhat like teeth. As the roller cone cutters roll on the bottom of the hole being drilled, the teeth or carbide inserts apply a high compressive load to the rock and fracture it. The cutting action of roller cone cutters is typically by a combination of crushing, chipping and scraping. The cuttings from a roller cone cutter are typically a mixture of moderately large chips and fine particles.

When drilling rock with a roller cone cutter, the fracture effect of loading on the teeth of the rock bed is limited due to the rock matrix surrounding the borehole. Failure of rock is prevented in a large degree by the restraint to movement offered by the surrounding rock. Thus, it appears in usual drilling operations that small cracks are created in the rock which return to the surface of the bottom of the wellbore creating chips instead of propagating deep into the rock itself. Thus, the bit tooth of the usual rock bit presses on the rock surface tending to create small cracks which propagate downward, but by virtue of the resistance to fracture offered by the surrounding rock matrix, a crack follows the path of least resistance and emerges at the surface on the bottom of the wellbore, thus creating the small chips.

U.S. Pat. No. 3,055,443 to Edwards disclosed a combination drag bit and roller cone cutter which removes the lateral restraint on a core to be drilled. The drag bit component cuts a single annular kerf forming a core which is received within a hollow body member and drilled by multicone rolling cutters arranged within the hollow body member. Windows are provided in the bit body adjacent to the multicone cutters to provide an egress for chips formed by the destruction of the core. This bit design causes rapid failure of the drag cutters, however, since virtually all the drilling fluid escapes through the windows and results in insufficient fluid flow to cool the drag bit component.

U.S. Pat. No. 4,892,159 to Holster describes a kerf-cutting bit wherein resistance of the rock to fracture is removed or reduced by employing a drill bit which destroys the rock rapidly and efficiently. The drill bit of Holster cuts multiple annular kerfs which result in more rapid drilling rates than those achieved by cutting a singular annular kerf.

The present invention is an improvement over that described in U.S. Pat. No. 4,892,159 and U.S. Pat. No. 3,055,443. The improvements of the present invention relate to how and where rolling cutters of the drill bit are attached to the bit body; the use of baffles and internal flow passages to improve the egress of rock cuttings as they are generated at the bottom of the wellbore by the drilling action of the rolling cutter; and the use of connecting webbs between individual kerf cutting elements to provide convective cooling of the cutting edges and to assist in rock chip removal from within the kerf cutters.

SUMMARY OF THE INVENTION

In one embodiment of the invention, a drill bit comprises a bit body with a lower end forming an outer kerf cutter; at least one inner drill member positioned concentrically within the bit body with a lower end forming an inner kerf cutter; and at least one rolling cutter attached by mounting means to the bit body in a manner to permit rotation relative to the mounting means wherein the rolling cutter(s) extend from the interior of the outer kerf cutter to the longitudinal axis of the drill bit.

In another embodiment, a drill bit comprises an outer kerf cutter, at least one inner kerf cutter, at least one rolling cutter, and at least one chipway port formed by the bit body and inner drill member extending from within the inner drill member and through the inner drill member and bit body to an outer surface of the bit body for channeling rock chips away from beneath the bit.

In yet another embodiment of the invention, the drill bit comprises an outer kerf cutter, at least one inner kerf cutter, at least one rolling cutter, and a plurality of baffles extending between the inner and outer kerf cutters adjacent to the rolling cutters for directing drilling mud discharged from a conduit over the rolling cutters.

In still another embodiment, the drill bit comprises an outer kerf cutter, at least one inner kerf cutter, and at least one rolling cutter wherein cutting edges of the outer and inner kerf cutters protrude from a connecting webb forming spaced between the protruding cutting edges to provide an egress for small rock chips and drilling fluid from beneath the bit and to provide convective cooling of the cutting edges of the kerf cutters.

In another embodiment, the bit body defines at least one longitudinally elongated slot forming a passage extending generally along the bit body for reducing pressure while the drill bit is moving in a wellbore.

In other embodiments of the invention, multiple annular kerfs may be cut by use of more than one inner drill members or only a single kerf may be cut by omitting the inner drill member.

A further aspect of the present invention is a method of drilling a wellbore in an earthen formation comprising cutting at least one annular kerf into the formation; grinding material from within the annular kerf by a rolling cutter means; delivering drilling fluid to the bottom of the wellbore; removing rock chips generated by the cutting by flow of the drilling fluid through a chipway port; and removing rock chips generated by grinding and cooling kerf cutting edges by flow of the drilling fluid around webbs located between the kerf cutting edges.

The above inventive embodiments may be employed separately or in combination.

BRIEF DESCRIPTION OF THE DRAWINGS

For a better understanding of the present invention, reference may be had to the drawings in which.

These drawings are not intended to in any way define the present invention but are provided solely for the purpose of illustrating certain preferred embodiments in applications of the present invention.

DESCRIPTION OF THE PREFERRED EMBODIMENT

Five specific improvements are provided by this invention over the prior art kerf-cutting bits of Holster (U.S. Pat. No. 4,892,159) and Edwards (U.S. Pat. No. 3,055,443). A first improvement relates to the reduction in the number of rolling cutters and the location and method of attachment to the drill bit body. Second, third and fourth improvements relate to increasing bit capability in removing drilled rock chips at a faster rate and increasing the cooling provided to the cutting elements mounted on the kerf cutters. A fifth improvement provides a method to reduce the surge and swab pressures associated with running bits having kerf cutters into and out of a wellbore.

Figure 1:
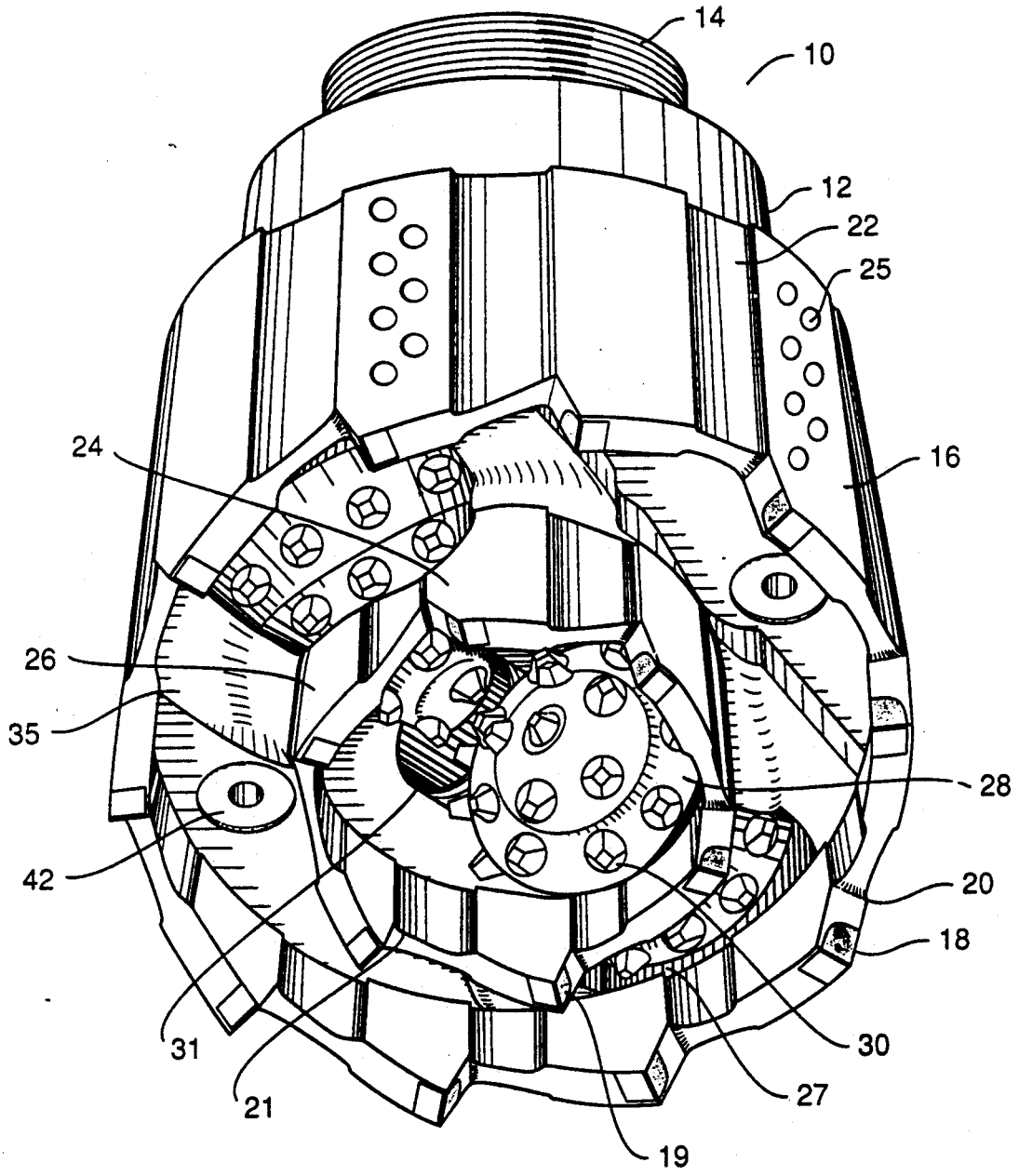
FIG. 1 is a perspective view of preferred embodiments of the drill bit of the present invention.
Figure 2:
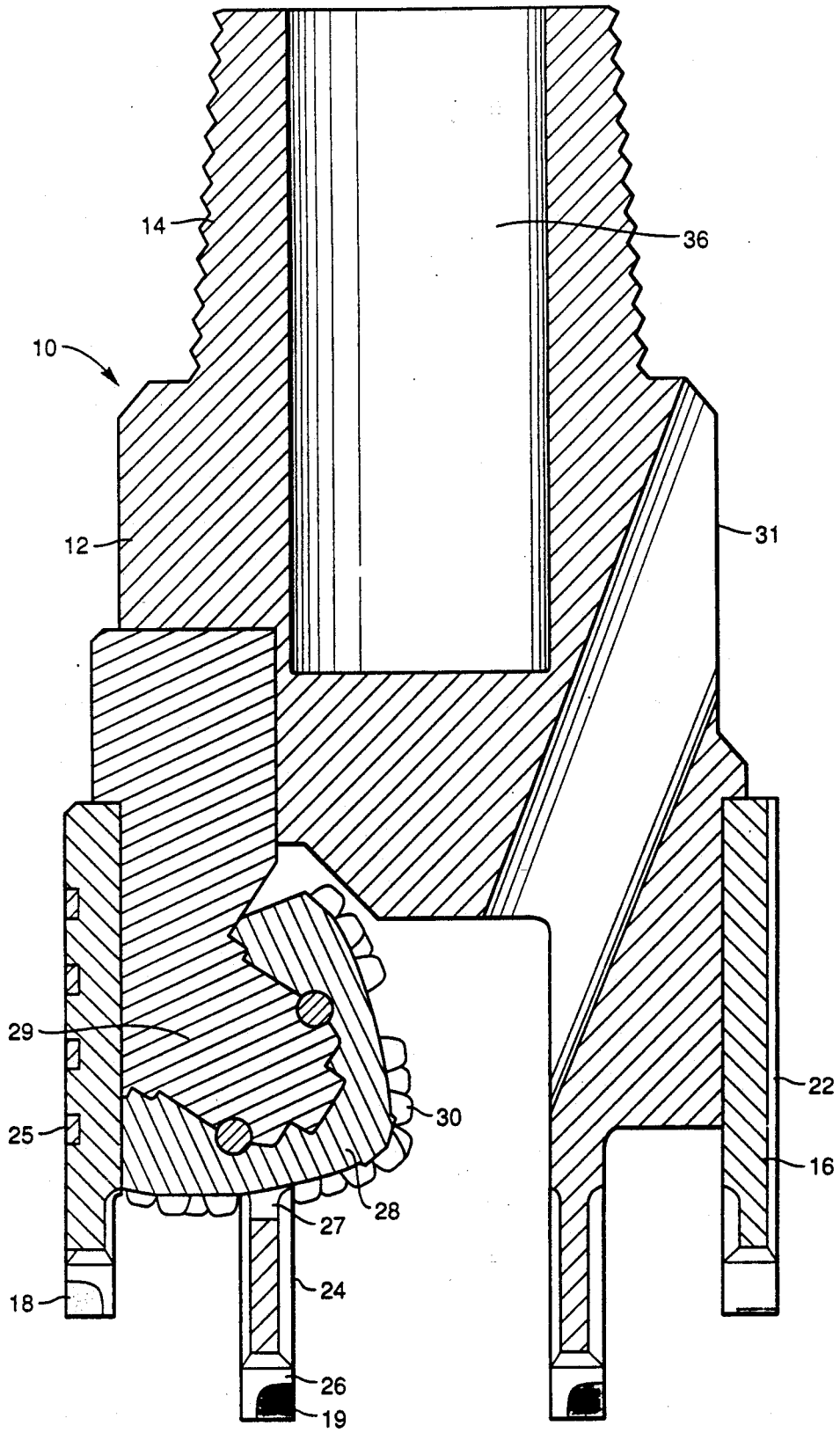
FIG. 2 is a cross section taken along line 2—2 of the drawing in FIG. 3 showing relative elevations of rolling cutters, kerf cutters, and chipway flow ports.
Figure 3:
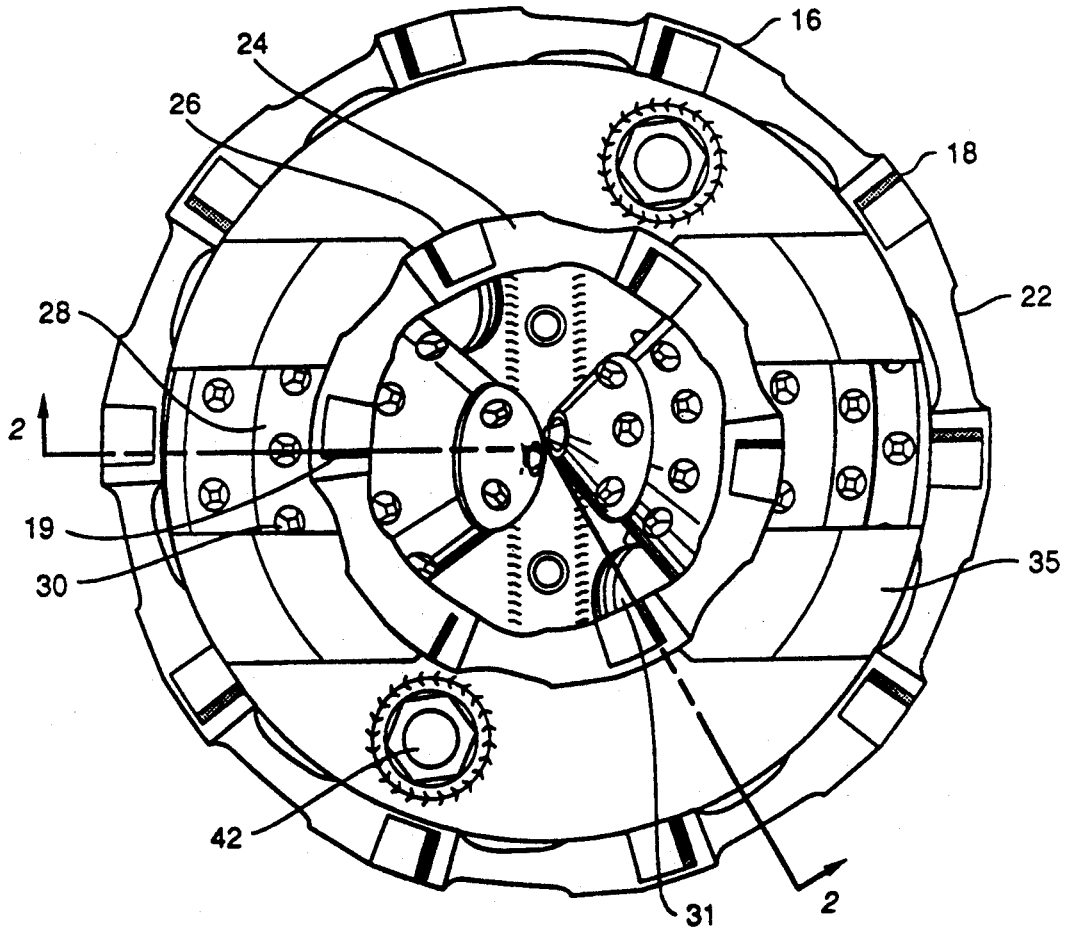
FIG. 3 is an end view of the drill bit of FIG. 1.

FIGS. 1, 2, and 3 illustrate a drill bit 10 incorporating a preferred embodiment of the present invention. Bit 10 includes a bit body 12 provided on its upper end with connecting means 14 in the form of the usual pin for the attachment to the lower end of a hollow drill string. Any suitable connecting means may be employed in this invention, however. Bit body 12 is provided on its lower end with an outer kerf cutter 16 in the form of a kerf cutting skirt having a generally saw-tooth configuration, a plurality of face plates 18 comprising diamonds, including either natural or synthetic [such as polycrystalline diamond compact material (PDC)], attached to cutting faces of cutter 16, and defining outlet passages 20 between adjacent skirt teeth. The outer kerf cutter skirt 16 may be molded or machined as an integral part of bit body 12 or it may be in the form of a cylindrical ring attached to bit body 12 by welding or threading. Bit body 12 is further provided with a plurality of spaced apart junk slots or grooves 22 extending longitudinally from cutter 16 toward the upper end of bit body 12. The combination of outlet passages 20 and spaced apart grooves 22 aids removal of cuttings and drilling fluid from the kerfs below the bit 10 and cools the cutters 18 on the outer kerf cutting skirt 16. Bit body 12 may be still further provided with gauge wear pads 25 in the conventional manner for slowing the rate of wear on a bit body made of steel or other suitable hard material. Gauge wear pads 25 may comprise tungsten carbide buttons and may be press-fit into pre-drilled holes on the surface of bit body 12 between grooves 22 so that pads 25 are flush with the surface of bit body 12.

Drill bit 10 also includes an inner drill member 24 positioned concentrically within bit body 12. Inner drill member 24 is connected at its upper end to bit body 12. Connection to bit body 12 may be in any manner including welding, threading, molding, or machining the bit body and inner drill member as one piece. Inner drill member 24 is provided on its lower end with an inner kerf cutter 26 in the form of a kerf cutting skirt having a generally saw-tooth configuration, a plurality of face plates 19 comprising diamonds, including either natural or synthetic, attached to cutting faces of cutter 26, and defining outlet passages 21 between adjacent skirt teeth.

As shown in FIG. 2, drill bit 10 further includes two spaced-apart rolling cutters 28 in the form of roller cone cutters attached by mounting means 29, such as journal segments, to bit body 12 in a manner to permit rotation relative to mounting means 29. Other conventional bearings such as floating sleeve friction or roller bearings may be used in place of journal bearings. Rolling cutters 28 are provided with cutting teeth 30 having cutting edges, said cutting teeth 30 comprising tungsten carbide or other suitable material. Rolling cutters are positioned so that lowermost cutting edges of cutting teeth 30 are above the teeth of outer and inner kerf cutters 16 and 26. The spacing of cutting teeth 30 on rolling cutters 28 may be varied in the conventional manner to minimize tracking and maximize cutting efficiency by assuring cutting over the full face of rolling cutters 28. The angle between the journal axis of each rolling cutter 28 and a radial line perpendicular to the bit longitudinal axis at the point of attachment of each rolling cutter 28 may also be varied to minimize tracking and maximize cutting efficiency. The external contour of rolling cutters 28 may also be varied to accommodate the angles of attachment to allow for rotation of rolling cutters 28. As an alternative, rolling cutters may have spaced apart cutting discs rather than individual teeth.

In one preferred embodiment of the invention, shown in FIGS. 1, 2, and 3, rolling cutters 28 extend from the inner surface of the outer kerf cutter to the longitudinal axis of the drill bit. When inner drill member 24 is present, rolling cutters 28 penetrate through a space defined by inner drill member 24. This embodiment represents one improvement over the prior art. The inventive attachment increases the bit loading that can be applied during drilling without causing premature structural failure. This improvement is achieved by reducing the total number of rolling cutters, increasing the size of the bearings, pins, and/or journals onto which they are affixed, and improving the location of the attachment point of the rolling cutters. Specifically, the rolling cutters are preferably in the form of rolling cones, and the rolling cones are attached to journal bearings which are cantilevered from locations just inside outer kerf cutter 16. The inner and outer rolling cutters of the prior art now effectively become unitized into one piece. In a preferred embodiment, two unitized pieces are present, each passing through openings 27 cut in inner drill member 24. In the most preferred case, two openings 27 exist, each located opposite the other, or 180° around the circumference of the inner kerf cutting skirt from the other. The opening clearances are more easily visualized by examining FIG. 4 which shows a side view of inner drill member 24 with opening 27 cut through inner drill member 24 and the respective rolling cutter through opening 27. Outer kerf cutter 16 has been removed to enhance visualization of the opening in inner drill member 24 and the resulting clearance between the rolling cutter 28 and inner drill member 24. Openings 27 are sized to be large enough to allow egress of rock chips generated in the annular space between the inner and outer kerf cutters 26 and 16, not shown.

Figure 5:
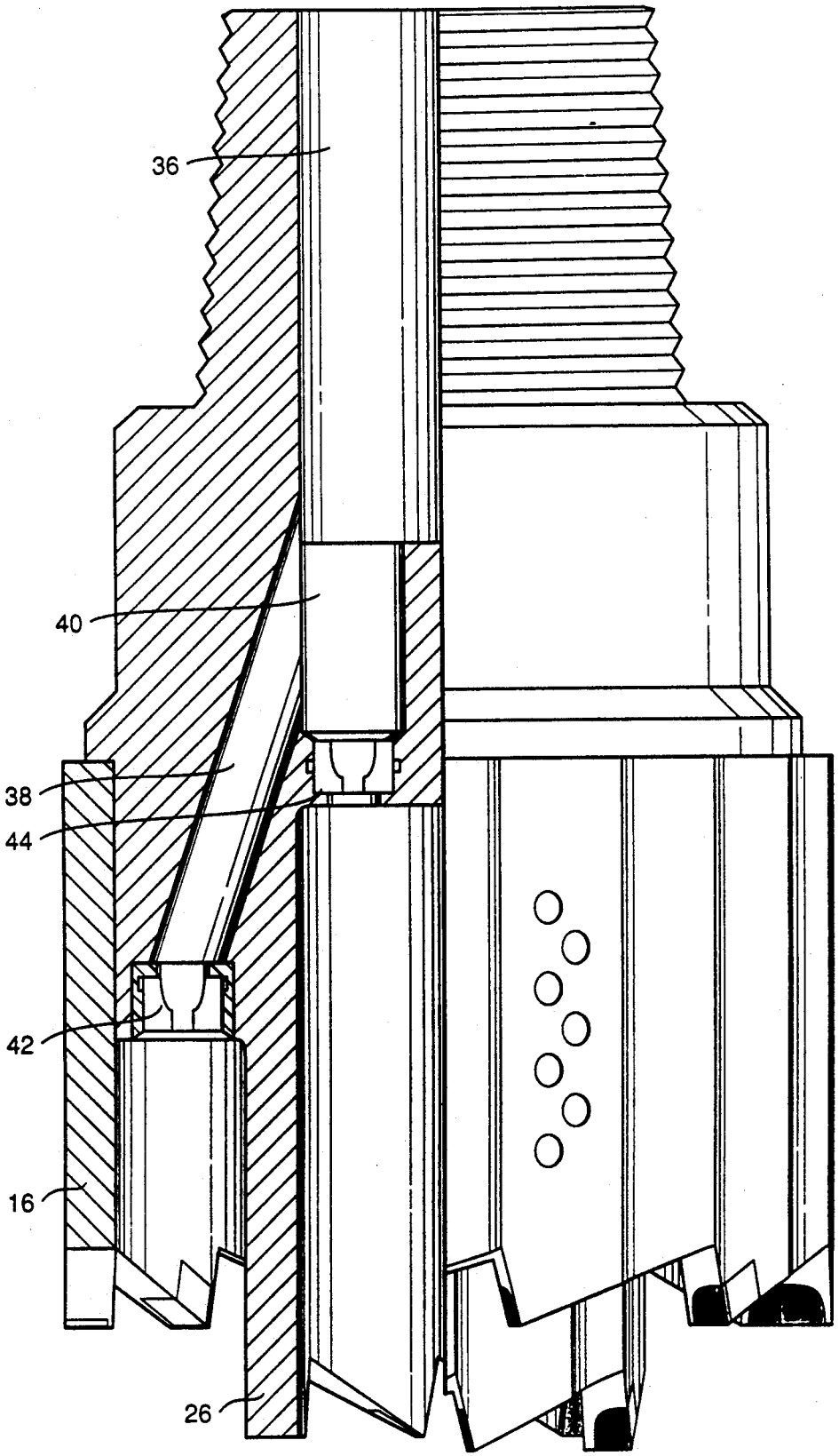
FIG. 5 is a cross sectional view of the inner flow delivery conduit, passages and jet nozzles.

Rock chips and cuttings are removed from between and beneath rolling cutters 28 and outer and inner kerf cutters 16 and 26 by drilling fluid delivered through bit 10 by means of a drilling fluid conduit 36, shown in FIG. 2, which connects to the hollow drill string, now shown. Drilling fluid is delivered separately to jet nozzles by fluid passageways 38 and 40, as shown in FIG. 5. Passageways 38 discharge drilling fluid through jet nozzles 42 located between each of rolling cutters 28 and the inner and outer kerf cutting skirts 26 and 16; passageways 40 discharge drilling fluid through jet nozzles 44 located inside the inner kerf cutter 26.

In another preferred embodiment, drill bit 10 includes chipway ports, 31, shown in FIG. 2, formed by bit body 12 and inner drill member 24 extending from within inner drill member 24 through inner drill member 24 and bit body 12 to an outer surface of bit body 12 for channeling rock chips away from beneath the drill bit 10. This embodiment represents a second improvement to kerf-cutting bits of the prior art. Chipway ports 31 connect the space within inner drill member 24 to the exterior of bit 10 for the purpose of assisting in removal of the rock chips. These chipway ports 31 effectively trail or follow rolling cutters 28 as bit 10 is rotated about the bottom of a hole and provide a path for rapid egress of chips generated beneath the drill bit.

For the bit shown in FIGS. 1 through 5, the drilling fluid carries cuttings and rock chips from the regions around and beneath the kerf cutters and rolling cutters through ports 31 extending through bit 10, through outlet passages 20 and 21, and around bit 10 through grooves 22.

Figure 4:
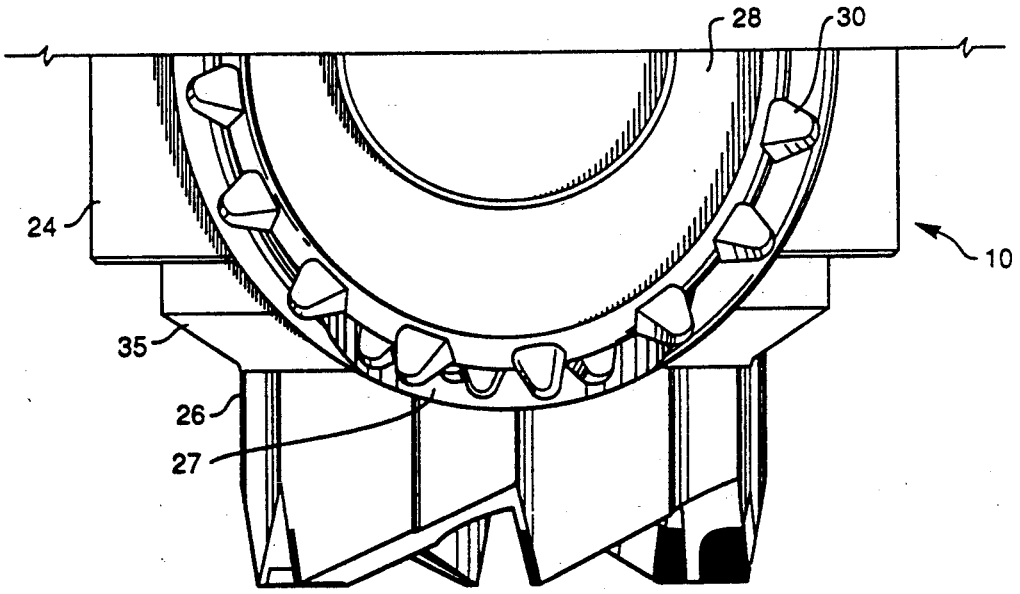
FIG. 4 is a partial elevation view of a preferred inner drill member, the opening for the rolling cutters, and flow baffles.

In another preferred embodiment, drill bit 10 includes a plurality of baffles 35 shown in FIGS. 3 and 4 which may be formed by bit body 12 and which extend between outer and inner kerf cutters 16 and 26 (now shown) for directing and accelerating drilling mud discharged from fluid passageways 38 over the plurality of rolling cutters 28. This third improvement over the prior art may be added to expedite chip removal. Baffles 35 can be added to the bottom of bit body 10, between the annular cutters 16 and 26 and immediately adjacent to either side of each of the rolling cutters 28. For the two-cone bit shown in FIGS. 1, 2, and 3, four baffles 35 are present. FIG. 4 shows the profile of a pair of baffles 35 adjacent to rolling cone cutter 28. Baffles 35 serve to direct and accelerate the drilling mud being discharged from jet nozzles 42 located between the kerf cutters 16 and 26 over rolling cutters 28 at the point where the rock chips are being created, as they are being created. This high velocity flow which is parallel to the bottom of the hole can more effectively entrain rock chips than if the flow were not otherwise accelerated to a high velocity. The high velocity drilling fluid flow and the freshly cut rock chips then flow through openings 27 in the inner drill member 24 toward the interior of the bit and the chipway ports 31. The drilling fluid flow and entrained rock chips may then be egressed through chipway ports 31 previously described.

Figure 6:
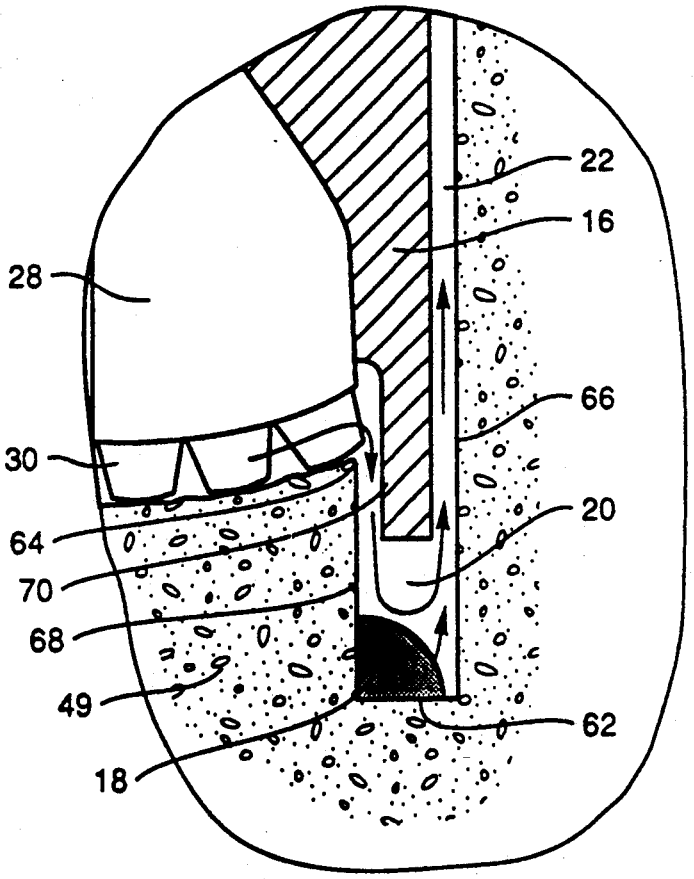
FIG. 6 is a cross section of a portion of the outer kerf cutter taken along the line 6—6 of FIG. 7 and also shows drilling fluid flow streamlines under and around the outer kerf cutters.
Figure 7:
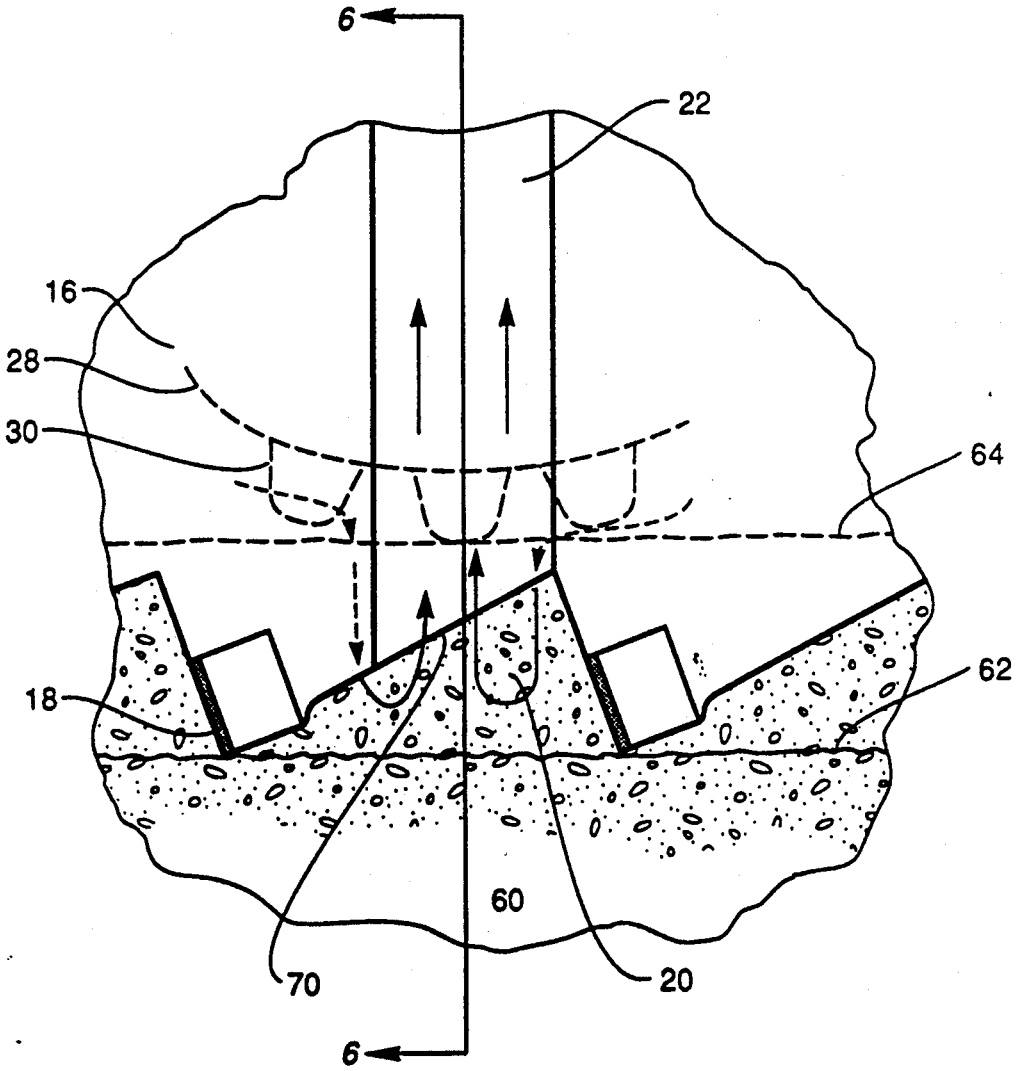
FIG. 7 shows a side view of portion of the outer kerf cutter and illustrates a profile of the shape of the opening(s) under the outer saw-tooth kerf cutters of the bit body.

In another embodiment of the present invention shown in FIGS. 6 and 7, cutting edges of the outer and inner kerf cutters 16 and 26 protrude from connecting webb 70 with spaces 20 formed between the protruding cutting edges. This embodiment represents a fourth improvement to prior art. Since the webbs between each cutting edge or face plate of the saw-tooth annular kerf cutters 16 and 26 extend into the annular kerfs cut in the rock passage of large rock chips generated by the rolling cutters is blocked, forcing the larger chips to egress out the chipway ports 31. However, the clearances, spaces 20, on either side of webbs 70 between the webb extensions and rock kerfs provide a path for drilling fluid and small rock chips to pass under the annular kerf cutter skirts and thereby provide convective cooling to the cutter face plates on the annular kerf cutters as depicted in FIGS. 6 and 7. In this manner, convective cooling can also be applied to the annular kerf cutter of the single kerf cutter bit of prior art (Edwards U.S. Pat. No. 3,055,443) and overcomes the heating problems encountered in application of that prior art.

FIGS. 6 and 7 illustrate how cooling of outer and inner kerf cutters 16 and 26 and chip removal from beneath the outer kerf cutter 16 are accomplished. Drilling mud, which is discharged from nozzles 42 (not shown) above and between kerf cutters 16 and 26, flows downward on the inside of the outer kerf cutter 16 in the space between earth material 49 and webb 70. Upon reaching space 20, the mud flow turns and passes in an upward direction through groove(s) 22 located on the outer side of outer kerf cutter 16. The flow path is bounded by webb 70, the inner wall 68, the bottom 62, and the outer wall 66 of the outer annular kerf. The curved lines with arrows shown in both FIGS. 6 and 7 represent mud flow streamlines and serve to illustrate how this flow pattern provides cooling to the cutter face plates 18.

A similar webbed pattern is provided on the lower end of inner kerf cutter 26 to provide cooling to the plurality of face plates 19 attached to the cutting faces of the inner kerf cutter 26.

Optionally, the relative vertical location of the rolling cutters could be adjusted downward so that the lowermost cutting teeth on the rolling cutters are sufficiently below the highest portion of the webbed structure between adjacent kerf cutter face plates so as to allow both increased drilling fluid flow for cooling and egress of larger rock chips generated by the rolling cutters. An additional option with this improvement to the single kerf cutter bit of prior art would be to place the rolling cutters that are interior to the single kerf cutter such that the point of tooth contact 64 with the rock is well below the uppermost portion of each of the webbs between adjacent kerf cutter face plates, thereby further increasing the portion of the space 20 that allows rock chip passage. Removal or elimination of the internal chipway ports would then force all rock chips and drilling fluid flow to exit from below the drill bit through the various spaces 20 under the annular kerf cutter 16 and up grooves 22.

Figure 8:
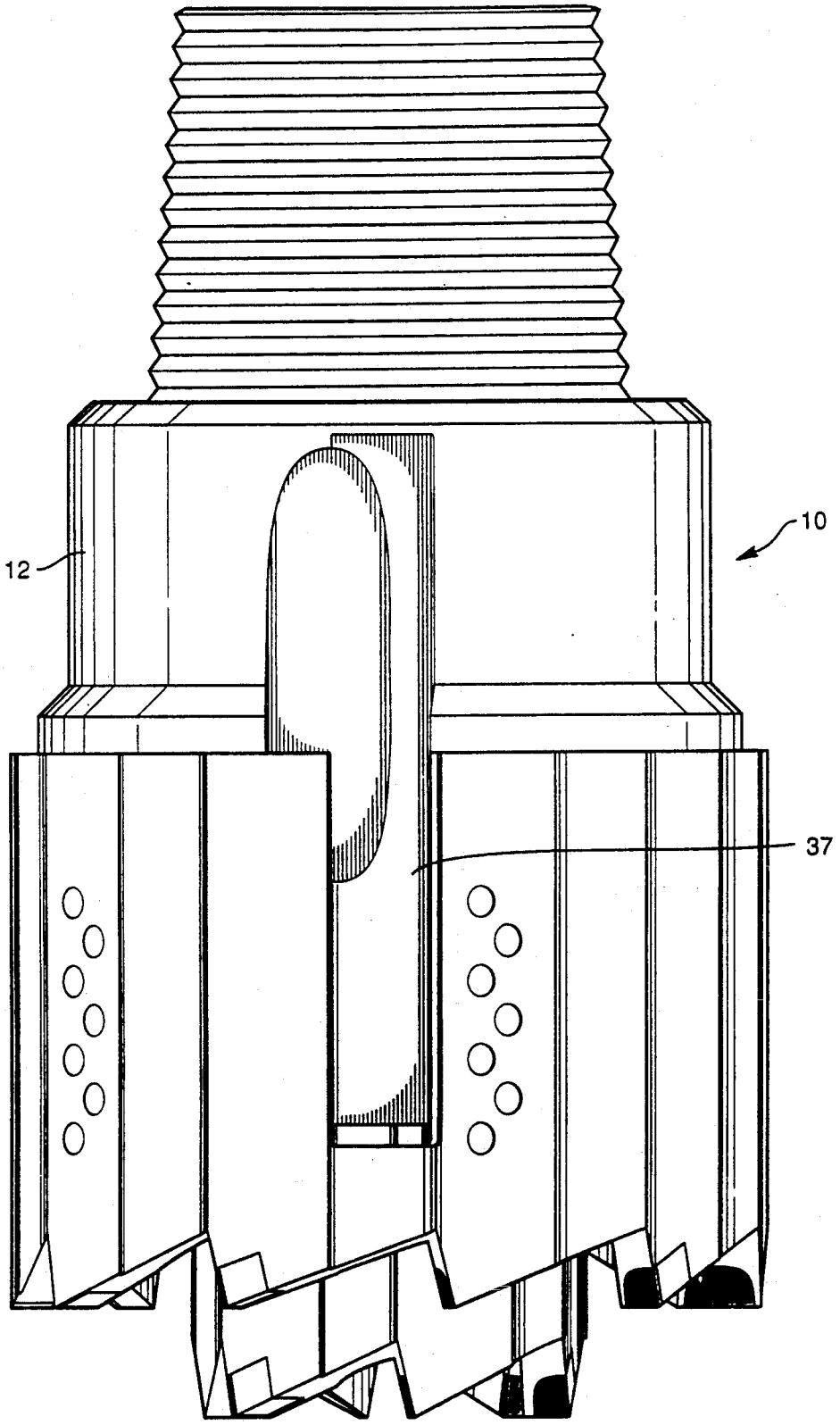
FIG. 8 is an elevation view of the bit in FIG. 1 showing optional flow channels for reducing surge and swab pressures.
Figure 9:
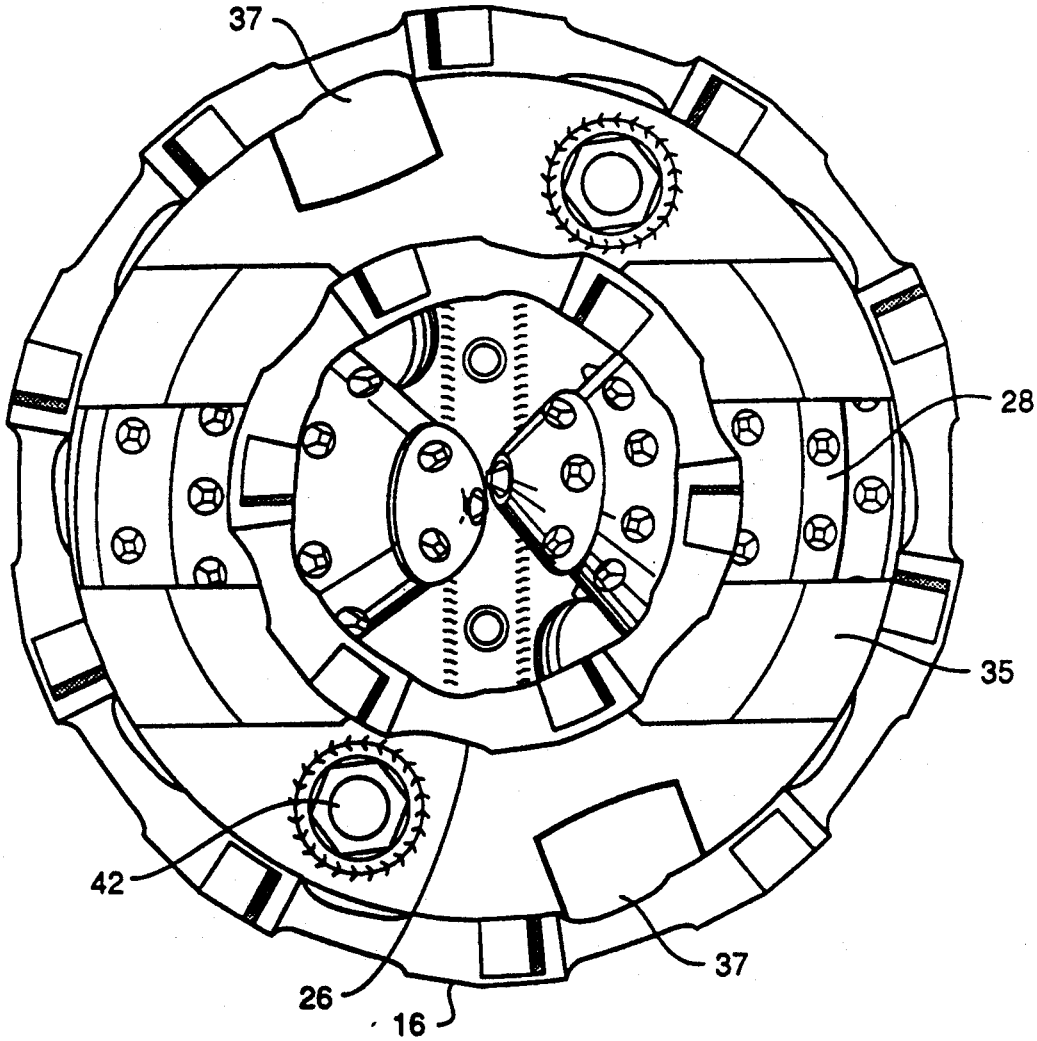
FIG. 9 is an end view of the bit of FIG. 8.

Drill bit 10 may include a plurality of longitudinally elongated slots 37, shown in FIGS. 8 and 9, forming channels or passages extending generally longitudinally along the bit body for enhanced removal of rock chips and for reducing surge or swab pressure while drill bit 10 is moved in and out of a wellbore. The slot does not extend to the edges of the outer kerf cutter as do grooves 22 and it may penetrate through the bit body into the space defined between the bit body and inner drill member depending on how drill bit 10 is constructed. While drilling, the presence of slots 37 will negate the effect of baffles 35, however. Therefore, if this option is used, use of baffles 35 is unnecessary. This fifth improved feature can be added as an option to the kerf cutting bit described herein. In certain drilling situations, the density, the viscosity and the gel-strength of the drilling fluid may be sufficiently high so as to create large surge pressures and swab pressures as the drill bit is lowered into the hole or raised from the bottom of the hole, respectively. By adding preferably at least two slots 37 connecting the space bounded by kerf cutters 16 and 26 to the shank or upper portion of the bit, the magnitude of the surge and swab pressure will be reduced while running the bit to the bottom of a wellbore or extracting it to the surface.

Figure 10:
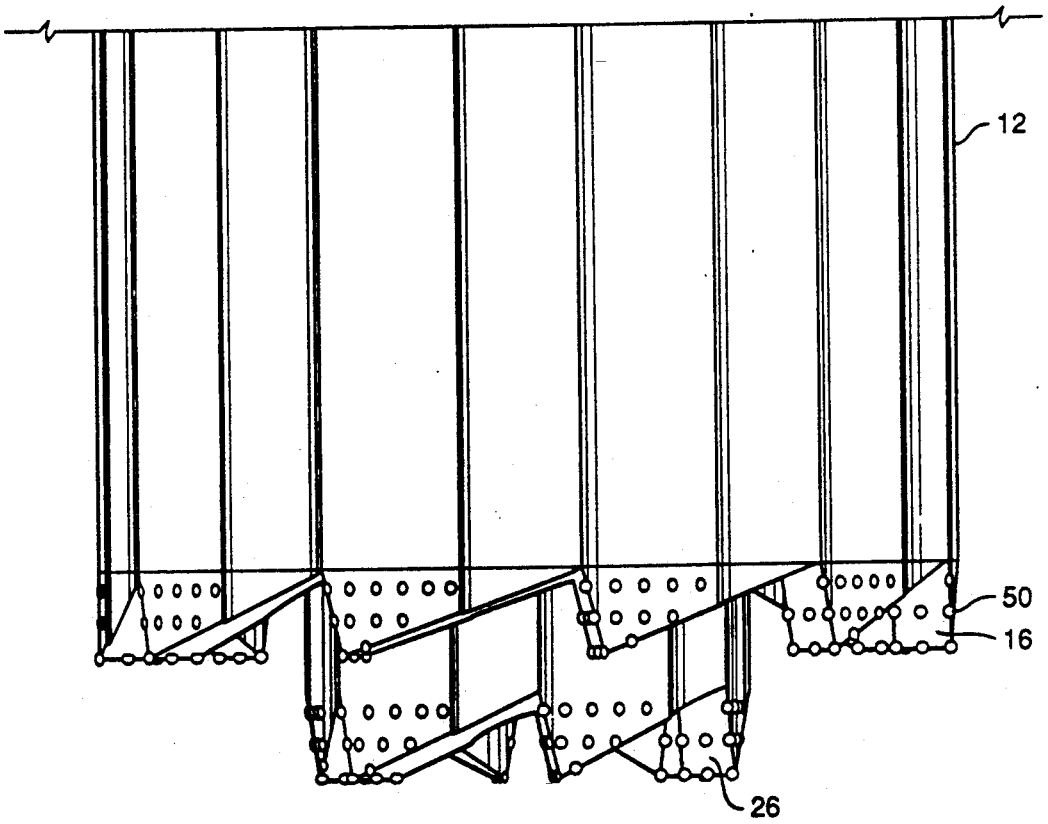
FIG. 10 is a partial elevation view of another embodiment of the kerf cutter of the bit body and inner drill member.

In another embodiment of the present invention shown in FIG. 10, kerf cutter 16 or 26 may form a kerf-cutting skirt having a generally saw-tooth configuration provided with abrasive resistant means 50 embedded on cutting faces of the cutter. Abrasive resistant means 50 may comprise diamonds, including either natural or synthetic [such as thermally stable polycrystalline diamond material (PDC)], diamond-tungsten carbide matrix, carbides such as, tungsten carbide, boron carbide or silicon carbide, or any other suitable hard material.

Figure 11:
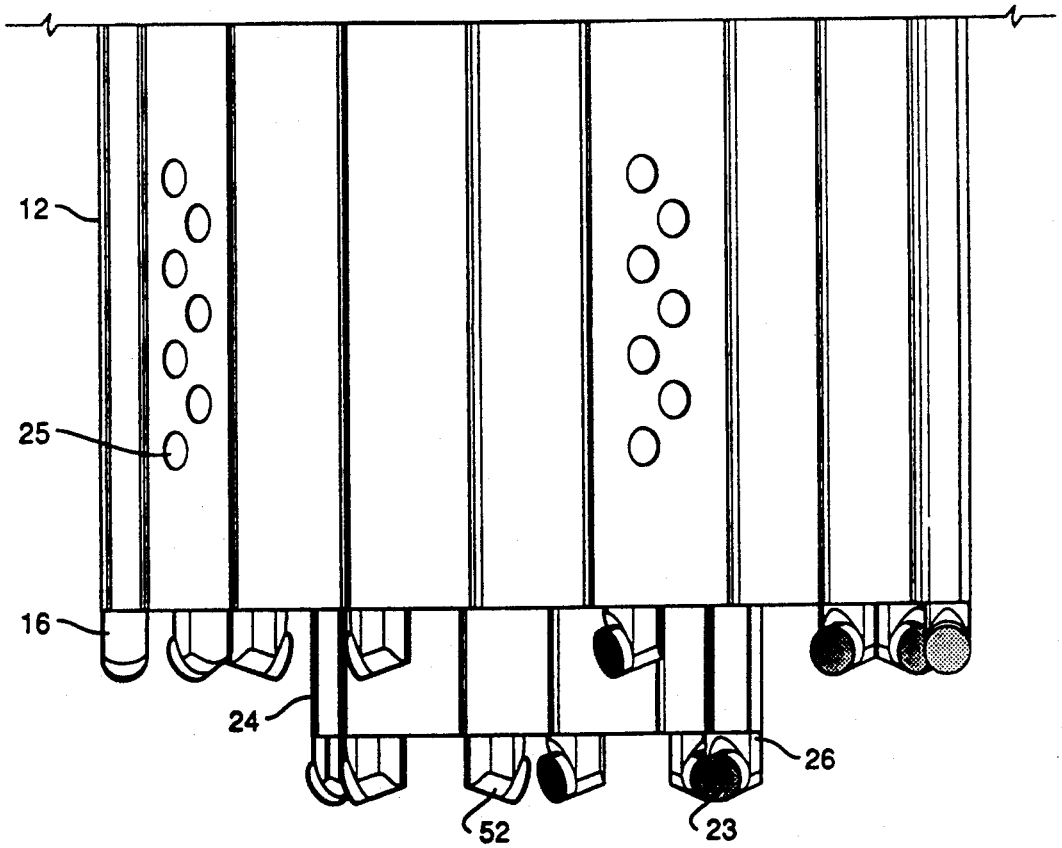
FIG. 11 is an elevation view showing yet another embodiment of the kerf cutter of the bit body and inner drill member.

In another embodiment shown in FIG. 11, the kerf cutters 16 or 26 may comprise a plurality of studs 52 protruding from the lower end of bit body 12 or inner drill member 24 and may be provided with abrasive resistant means on cutting faces of studs 52. Again, abrasive resistant means may comprise diamonds, including either natural or synthetic, diamond-tungsten carbide matrix, carbides such as, tungsten carbide, boron carbide or silicon carbide, or any other suitable hard material. Face plates 23 comprising diamonds, including either natural or synthetic, may also be attached to cutting faces of studs 52 as shown in FIG. 11 and may be constructed from PDC disks. This embodiment of kerf cutter 16 or 26 may be constructed by press fitting studs 52 into holes pre-drilled in the lower end of bit body 12 or inner drill member 24.

Figure 12:
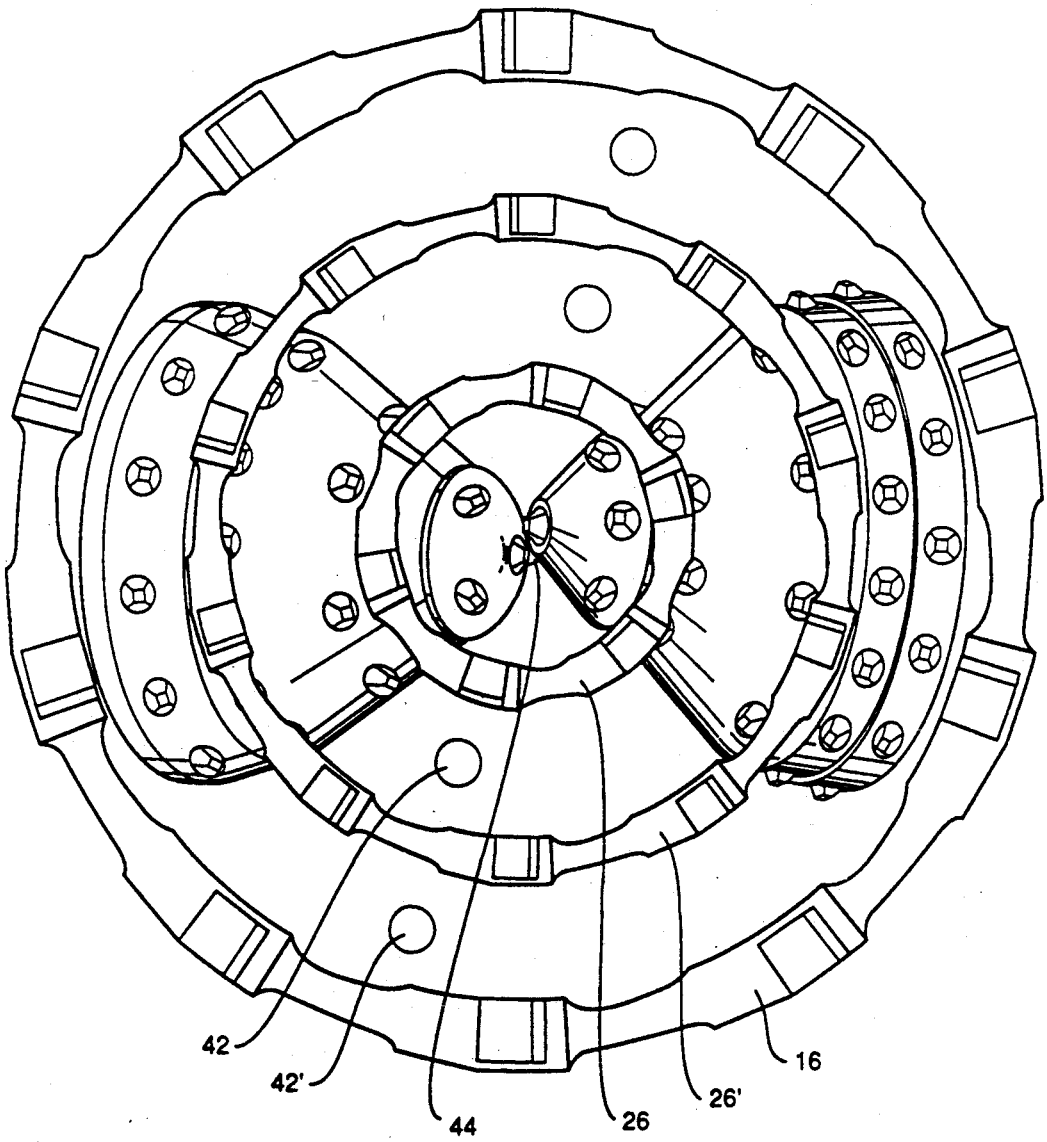
FIG. 12 is an end view of another embodiment of the present invention showing multiple kerf cutters.

In still another embodiment of the invention shown in FIG. 12, a plurality of inner drill members provided on lower ends with kerf cutters 26 and 26' are positioned concentrically one within the other and within the bit body which is provided on its lower end with kerf cutter 16. Each of the plurality of inner drill members is connected at its upper end to bit body 12. Rolling cutters 28 are attachedly arranged to bit body 12 and are positioned so that lowermost cutting edges are above the cutting edges of the kerf cutters of the bit body and inner drill members. Upon rotation of the bit, annular cutters 26, 26', and 16 cut concentric annular kerfs ahead of rolling cutters. Rolling cutters 28 remove material between concentric annular kerfs and material surrounded by and within the innermost annular kerf. Cuttings and rock chips are removed from between and beneath annular cutters 26, 26', and 16 and rolling cutters by drilling fluid discharged from jet nozzles 42 and 42' located between rolling cutters 28 and jet nozzle 44 centrally located within kerf cutter 26. There may be one, two, or three rolling cutters 28 and any number of inner kerf cutters (26 and 26'), to include 0, 1, and 2. For the purposes of example, two rolling cutters and two inner kerf cutters are shown here.

Figure 13:
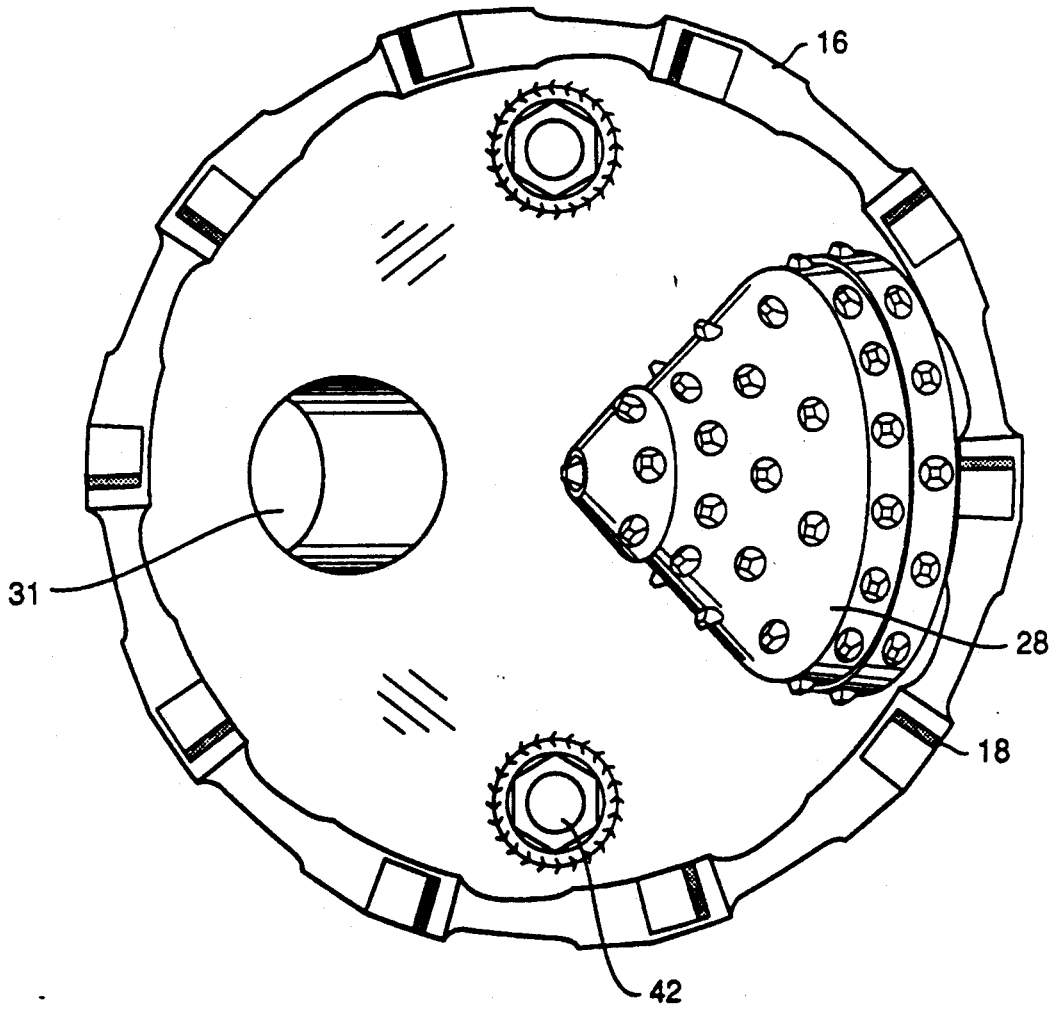
FIG. 13 is an end view of another embodiment of this invention having only one kerf cutter and one rolling cutter.

In yet another embodiment of the invention shown in FIG. 13, the inner drill member is absent and a single kerf is cut by the outer kerf cutter 16. This embodiment is useful for drilling small holes requiring small bit sizes. For small bit sizes, it may not be possible to fit more than one kerf cutter on the bit, and the use of only one kerf cutter is therefore within the scope of this invention. Although two or more kerfs are preferred, one kerf will improve the rate of penetration above bits cutting no kerfs. In small bit sizes, it is also anticipated that only one rolling cutter may be used. This embodiment will provide a large journal bearing and greater overall structural strength and load capacity for small diameter drill bits such as diameters of six inches or less.

Figure 14:
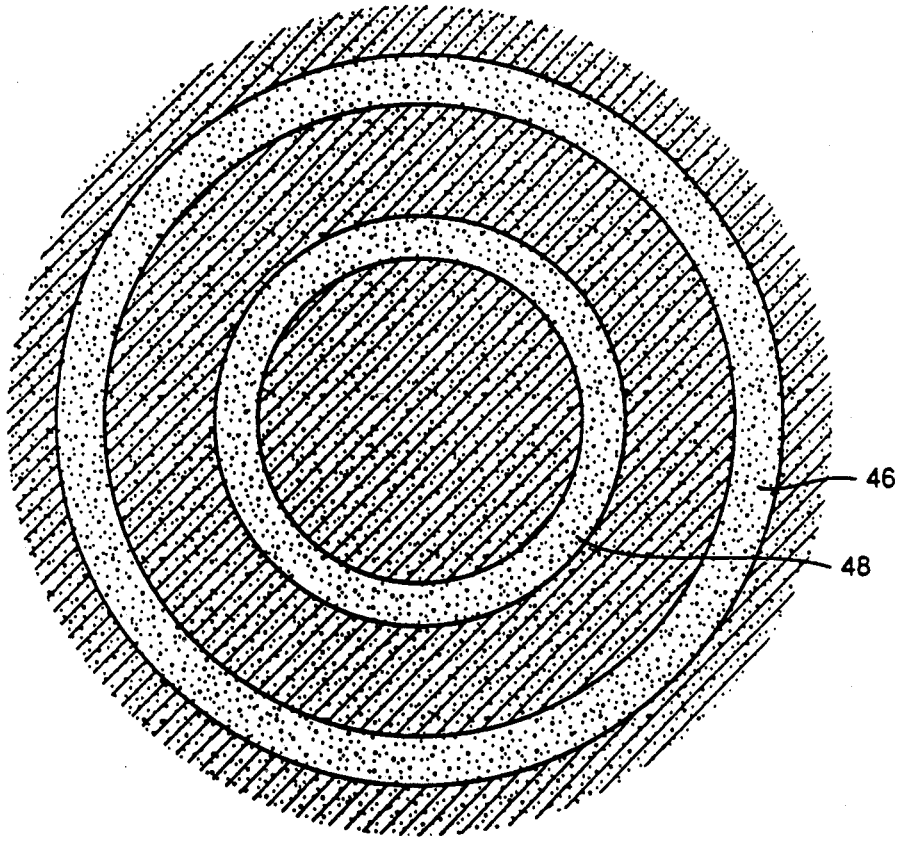
FIG. 14 is a top view of FIG. 15 taken along line 4—4 showing the inner and outer annular kerfs cut by the drill bit of the present invention.
Figure 15:
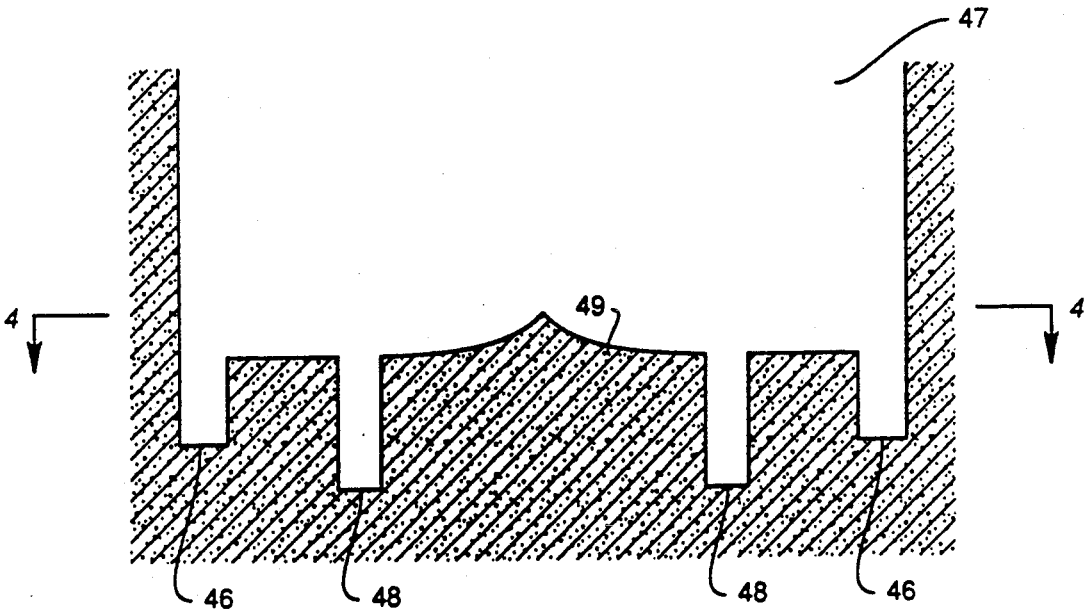
FIG. 15 is a cross sectional elevation view of the borehole cut by the kerf-cutting bit.

FIGS. 14 and 15 illustrate the bottom of a borehole 47 in which outer kerf cutter 16 has cut an outer annular kerf 46 and inner kerf cutter 26 has cut an inner annular kerf 48 positioned concentrically within the outer annular kerf 46 upon rotation of bit 10, shown in FIGS. 1 through 5. Since the lowermost cutting edges of rolling cutters 28 are positioned above the teeth of outer and inner kerf cutters 16 an 26, the annular kerfs 46 and 48 are cut into the earth material 49 ahead of rolling cutters 28 thereby removing lateral restraint from material 49 between and within the outer and inner kerf cutters. Rolling cutters 28 fracture and remove material from between and within annular kerfs 46 and 48 rapidly and efficiently by crushing, chipping, grinding, and scraping action of the cutting teeth 30.

Another aspect of the present invention is a method of drilling a wellbore in an earthen formation comprising cutting at least one annular kerf into the formation by a drill bit having a kerf cutting means with cutting edges positioned on the lower end thereof; grinding material from within the annular kerf by a rolling cutting means positioned within the drill bit; delivering drilling fluid to the lower end of the drill bit; removing rock chips generated by the grinding by flow of drilling fluid through a chipway port extending from within the kerf cutting means to an outside surface of the drill bit; and removing rock chips generated by the kerf cutting means and cooling the cutting edges of the kerf cutting means by flow of drilling fluid through outlet passages wherein said passages are defined between adjacent protruding cutting edges of said kerf cutting means.

It is to be understood that any combination of the embodiments of the invention including rolling cutter and kerf cutter variations described in the above embodiments are included in the present invention.

In order to illustrate the benefits of a multi-kerf cutting bit, laboratory drilling experiments were conducted using pre-kerfed rock and an oil field type bit, as discussed in Example I.

Also a kerf-cutting drill bit incorporating some of the embodiments of the present invention was tested, as discussed in Example II, to prove that the bit can indeed achieve increased drilling rates over conventional oil field bits designed for the same rock type.

EXAMPLE I

Slabs of Carthage Marble were prepared by sawing 36 in. long by 15.5 in. diameter cores into six slabs each. Using a drill press with diamond core saws, some of these slabs were cut to have a single annular kerf, some slabs were cut to have multiple annular kerfs, and other slabs were left uncut. The slabs were then stacked and cemented together to form 36 in. long test samples. The assembled test samples were then jacketed with rubber and sealed by placing metal plates at each end. The top plate had an opening to allow a bit to pass through and contact the rock. These top and bottom plates were held in contact with the rock by threaded steel rods that extended axially along the perimeter of the samples and loaded in tension, thereby compressing the individual pre-kerfed slabs together tightly. The rubber sleeve was tightly wrapped around the entire sample to seal out confining fluid. Cutting a single kerf ahead of the primary rock cutting tool increased drilling rate by 63%, whereas cutting two concentric kerfs increased drilling rate by more than a factor of 4. Depth of kerf appears to be important when single kerfs are present, but much less significant when two or more annular kerfs have been cut. It was also found that the benefits are most apparent when the roller cone bit cutting structure is well matched to the kind of rock being drilled.

EXAMPLE II

Figure 16:
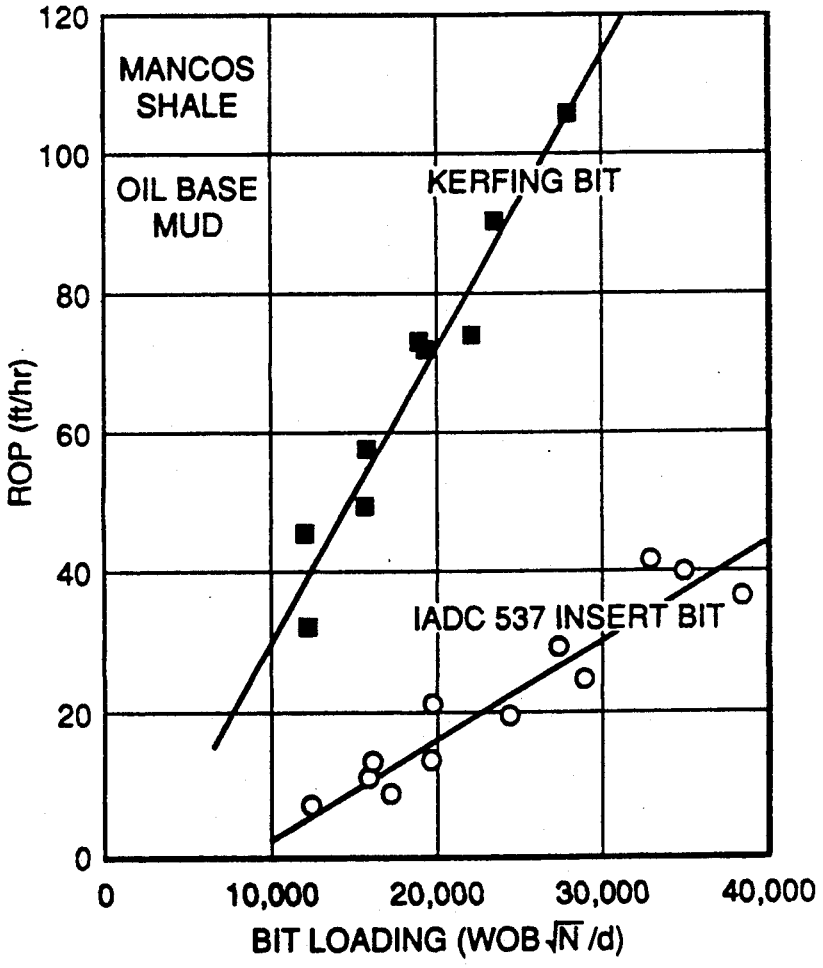
FIG. 16 is a plot showing a comparison of drilling rates between a bit having embodiments of the present invention and a prior art bit while drilling in Mancos shale.
Figure 17:
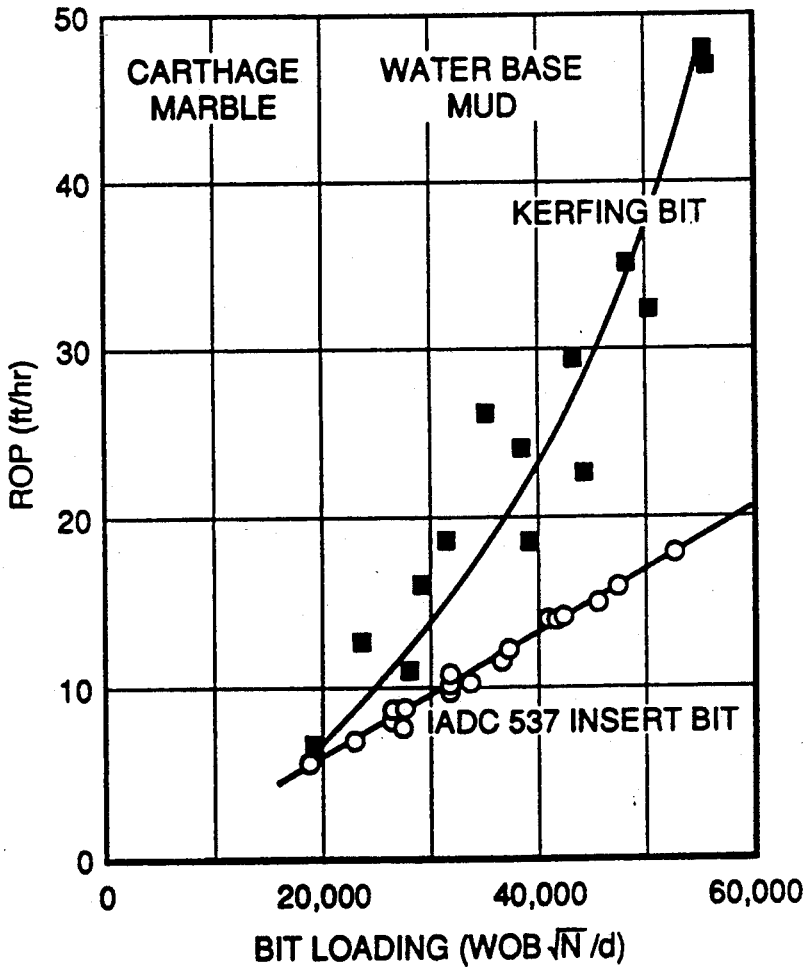
FIG. 17 is a plot showing a comparison of drilling rates between a bit having embodiments of the present invention and a prior art bit while drilling in carthage marble.

A 9 $\frac{7}{8}$" diameter bit with two kerf cutters, two rolling cone cutters that are attached on journal bearings extending from the interior of the outer annular cutter, each passing through openings cut in the inner drill member, and four baffles located in the annular space between the two annular cutters, and with two "chip way" ports extending from the space inside the inner drill member to the exterior of the bit at its shank was tested. Two rock types were drilled with this bit over a wide range of bit loadings. The "weight-on-bit" (forces applied normal to the rock face) varied from 15,000 lb to 50,000 lb. Bit rotational speeds varied from 40 to 120 revolutions per minute. The drilling rates obtained were compared with those obtained from similar experiments with conventional rolling cone bits with equivalent cutting structures on their rolling cones (IADC 537 bits). The results are compared in FIGS. 16 and 17. FIG. 16 shows the measured drill rates or rates of penetration (ROP) for the bit with annular kerf cutters and a conventional IADC 537 bit loaded over a similar range of weights and rotational speeds while drilling Mancos shale rock. The resulting ROP's are plotted as functions of the bit loading parameter WOB $\sqrt{N/d}$ which allows for normalization and compression of the data. Note that at an equivalent loading parameter value of 30,000, the bit with the two annular kerf cutters, two rolling cones openings, baffles and egress ports drills about four (4) times as fast as the conventional rolling cone bit (IADC 537). FIG. 17 shows a similar comparison of the same two bits while drilling carthage marble (a medium hard limestone). At equivalent bit loading parameter values of 50,000, the bit with the features described herein drilled approximately 2 times as fast as the conventional IADC 537 bit.

The preferred embodiments of the present invention have been described above. It should be understood that the foregoing description is intended only to illustrate certain preferred embodiments of the invention and is not intended to define the invention in any way. Other embodiments of the invention can be employed without departing from the full scope of the invention as set forth in the appended claims.

We claim:

1. A drill bit comprising:

(a) a bit body having an upper end and a lower end, said lower end having an outer kerf cutter with cutting edges for cutting an outer annular kerf on rotation of the drill bit;

(b) an inner drill member positioned concentrically within said bit body having an upper end connected to said bit body and a lower end having an inner kerf cutter with cutting edges for cutting an inner annular kerf positioned within the outer annular kerf on rotation of the drill bit;

(c) at least one rolling cutter attached by mounting means to said bit body in a manner to permit rotation relative to the mounting means and extending from the interior of the outer kerf cutter to the longitudinal axis of the drill bit, said rolling cutter having cutting edges wherein lowermost cutting edges are positioned above cutting edges of said inner and outer kerf cutters to remove material between said inner kerf cutter and said outer kerf cutter and material within said inner kerf cutter;

(d) a drilling fluid conduit disposed within said drill bit for delivering drilling fluid to said inner and outer kerf cutters and said rolling cutter, said conduit separately discharging fluid to regions bounded between and within said inner and outer kerf cutters; and (e) means for connecting the upper ends of said bit body and drilling fluid conduit to a string of drill pipe.

2. A drill bit in accordance with claim 1 wherein said bit body and inner drill member form a chipway extending from within the inner drill member and through the inner drill member and bit body to an outer surface of the bit body for channeling rock chips away from beneath said drill bit.

3. A drill bit in accordance with claim 1 wherein a plurality of baffles extend between said inner and outer kerf cutters and adjacent to said rolling cutters for directing and accelerating to a high velocity drilling fluid discharged from said conduit over said rolling cutters.

4. A drill bit in accordance with claim 3 wherein said drilling fluid is discharged from said conduit through a plurality of jet nozzles.

5. A drill bit in accordance with claim 1 wherein said cutting edges of said outer kerf cutter protrude from a connecting webb with spaced formed between said protruding cutting edges for egress of drilling fluid and small rock chips from beneath said bit and for convective cooling of the cutting edges of said outer kerf cutter.

6. A drill bit in accordance with claim 1 wherein said cutting edges of said inner kerf cutter protrude from a connecting webb with spaced formed between said protruding cutting edges for egress of drilling fluid and small rock chips from beneath said bit and for convective cooling of the cutting edges of said inner kerf cutter.

7. A drill bit in accordance with claim 1 wherein said bit body defines a longitudinally elongated slot forming a passage extending generally along the bit body for reducing pressure while said drill bit is moving in a wellbore.

8. A drill bit in accordance with claim 1 wherein:

(a) said bit body defines a plurality of spaced apart grooves extending longitudinally from the outer kerf cutter of said bit body toward the upper end of said bit body for removal of drilling fluid and cuttings from below the bit;

(b) the outer kerf cutter of said bit body comprises a kerf-cutting skirt having a generally saw-tooth configuration, polycrystalline diamond compact material on cutting faces of the skirt and defining outlet passages between adjacent skirt teeth for removal of cuttings from below the bit;

(c) the inner kerf cutter of said inner drill member comprises a kerf-cutting skirt having a generally saw-tooth configuration, polycrystalline diamond compact material on cutting faces of the skirt and defining outlet passages between adjacent skirt teeth for removal of cuttings from below the bit;

(d) a rolling cutter comprising at least two roller cone cutters having a plurality of tungsten carbide insert teeth protruding from the surface of said roller cone cutters; and (e) said drilling fluid conduit comprises separate passageways discharging above and within each of said kerf cutters through jet nozzles.

9. A drill bit comprising:

(a) a bit body having an upper end and a lower end, said lower end having an outer kerf cutter with cutting edges for cutting an outer annular kerf on rotation of the drill bit;

(b) an inner drill member positioned concentrically within said bit body having an upper end connected to said bit body and a lower end having an inner kerf cutter with cutting edges for cutting an inner annular kerf positioned within the outer annular kerf on rotation of the drill bit;

(c) at least one rolling cutter attached by mounting means to said bit body in a manner to permit rotation relative to the mounting means, said rolling cutter having cutting edges wherein lowermost cutting edges are positioned above cutting edges of said inner and outer kerf cutters to remove material between said inner kerf cutter and said outer kerf cutter and material within said inner kerf cutter;

(d) at least one chipway port formed by said bit body and inner drill member extending from within said inner drill member through said inner drill member and bit body to an outer surface of the bit body for channeling rock chips away from beneath the bit;

(e) a drilling fluid conduit disposed within said drill bit for delivering drilling fluid to said inner and outer kerf cutters and said rolling cutter, said conduit separately discharging fluid to regions bounded between and within said inner and outer kerf cutters; and (f) means for connecting the upper ends of said bit body and drilling fluid conduit to a string of drill pipe.

10. A drill bit in accordance with claim 9 wherein a plurality of baffles extend between said inner and outer kerf cutters and adjacent to said rolling cutters for directing and accelerating drilling fluid discharged from said conduit over said rolling cutters.

11. A drill bit in accordance with claim 9 wherein said cutting edges of said outer kerf cutter protrude from a connecting webb with spaced formed between said protruding cutting edges of egress of drilling fluid and small rock chips from beneath said bit and for convective cooling of the cutting edges of said outer kerf cutter.

12. A drill bit in accordance with claim 9 wherein said cutting edges of said inner kerf cutter protrude from a connecting webb with spaces formed between said protruding cutting edges for egress of drilling fluid and small rock chips from beneath said bit and for convective cooling of the cutting edges of said inner kerf cutter.

13. A drill bit in accordance with claim 9 wherein said bit body defines a longitudinally elongated slot forming a passage extending generally along the bit body for reducing pressure while said drill bit is moving in a wellbore.

14. A drill bit comprising:

(a) a bit body having an upper end and a lower end, said lower end forming an outer kerf cutter for cutting an outer annular kerf on rotation of the drill bit;

(b) a plurality of inner drill members positioned concentrically one within the other and within said bit body, each of said inner drill members having upper ends connected to said bit body and lower ends forming kerf cutters for cutting concentric annular kerfs on rotation of the drill bit;

(c) at least one rolling cutter attached by mounting means to said bit body in a manner to permit rotation relative to the mounting means and extending from the interior of the outer kerf cutter to the longitudinal axis of the drill bit, said rolling cutter having cutting edges wherein lowermost cutting edges are positioned above cutting edges of said inner and outer kerf cutters to remove material between said inner kerf cutter and said outer kerf cutter and material within said inner kerf cutter drill earth material between the concentric kerf cutters and inside the inner kerf cutter;

(d) a drilling fluid conduit disposed within said drill bit for delivering drilling fluid to said rolling cutters, and annular kerf cutters, said conduit comprising separate passageways discharging separately above and between said rolling cutters; and (e) means for connecting said drilling fluid conduit and the upper ends of said bit body to a string of drill pipe.

* * * * *